United States Patent [19]

Johansson

[11] 4,020,526

[45] May 3, 1977

[54] VACUUM CLEANER NOZZLE WITH A MOVABLE BRUSH

[75] Inventor: Erik Karl Gustav Johansson, Sollentuna, Sweden

[73] Assignee: Aktiebolaget Electrolux, Stockholm, Sweden

[22] Filed: Dec. 11, 1975

[21] Appl. No.: 639,616

[30] Foreign Application Priority Data

Dec. 19, 1974 Sweden ..... 7416003

[52] U.S. Cl. ..... 15/364; 15/381; 15/401

[51] Int. Cl.[2] ..... A47L 9/04

[58] Field of Search ..... 15/364, 380, 381, 382, 15/401

[56] References Cited

UNITED STATES PATENTS

| | | | |
|---|---|---|---|
| 1,470,894 | 10/1923 | Throop | 15/381 X |
| 2,631,688 | 3/1953 | Osborne et al. | 15/381 X |
| 2,635,278 | 4/1953 | Belknap | 15/381 X |
| 3,460,188 | 8/1969 | Boyd | 15/364 |

*Primary Examiner*—Christopher K. Moore
*Attorney, Agent, or Firm*—Alfred E. Miller

[57] ABSTRACT

A vacuum cleaner suction nozzle having a brush that is so mounted and arranged as to be capable of moving transversely of the length direction of the nozzle and during part of this movement is elevated from the work surface, while another part of the movement engages the work surface. During the latter movement, the dust and larger dirt particles are raised from the work or rug surface so as to be entrained with the air flow being drawn into the vacuum cleaner.

4 Claims, 1 Drawing Figure

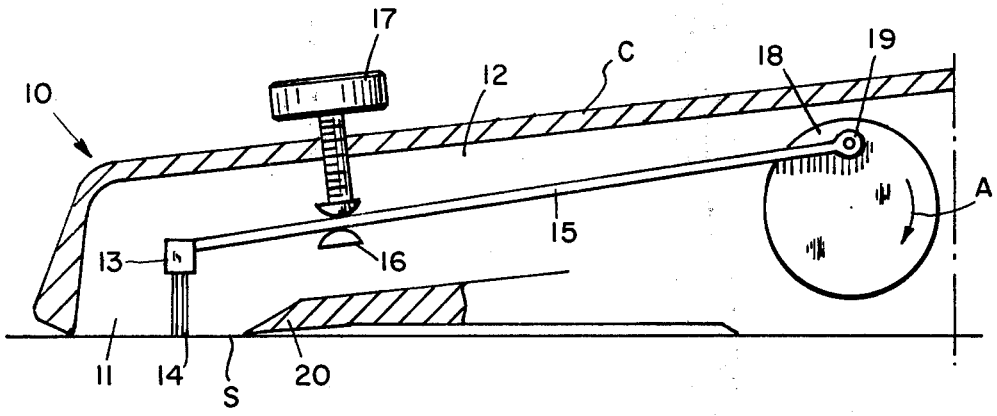
17
C
18
19
10
12
A
15
13
16
11
14
S
20

VACUUM CLEANER NOZZLE WITH A MOVABLE BRUSH

BACKGROUND OF THE INVENTION

Vacuum cleaners are known in which the brush is movable in the nozzle opening. For example the brush can be rotatable or movable back and forth. A brush of the latter type is described and shown in U.S. Pat. No. 1,336,760. A horizontally mounted eccentric disc causes the movement forwards and backwards of the brush whereby the tips of the brush bristles move on the work surface all the time, i.e. in the same horizontal plane as this surface. Thus, the object of the brush device shown and described in the aforesaid patent is to work on a soft surface, such as a short-piled rug, so that dust is stirred up by the brush and conducted by the suction air to a dust collector. It has been found, however, that the dust absorbing capability of this device is not sufficient to satisfy the present requirements in this respect. This is due to the fact that instead of being worked up from the rug the dust is forced into it by the brush.

SUMMARY OF THE INVENTION

The present invention relates to a vacuum cleaner nozzle which includes an elongated suction opening adjacent to the work surface and having a movable brush therein.

An object of the present invention is to provide a vacuum cleaner nozzle having a brush movable back and forth in the suction opening in directions transverse to the length direction of the opening. During a portion of said movement the brush is elevated from the work surface by means of a connected, elongated, generally horizontally disposed arm which is supported for both axial and tilting movement.

Another object of the present invention is to provide a bearing for the elongated arm which is manually adjustable for changing the distance of the bearing from the work surface.

A further object of the present invention is to provide a scraping element which rests on the work surface and functions to raise up particles of dirt and dust for entrainment with the air flow into the vacuum cleaner.

The invention will now be described with reference to the accompanying drawing, the sole FIGURE of which shows a vertical section through a nozzle constructed in accordance with the invention.

DESCRIPTION OF THE PREFERRED EMBODIMENT

As seen in the FIGURE, the nozzle is referred to generally by the reference numeral 10. Its front part has an opening 11 which extends along the entire width of the nozzle. The opening 11 is constructed to communicate by means of a channel or channels 12 and hoses (not shown) with a motor-fan unit (not shown) generating a negative pressure in the nozzle and drawing air through the nozzle opening. The front part of the nozzle is provided with an elongated brush 13, whose bristle tips 14 at intervals contact the work surface. The brush is shown mounted on one end of a lever arm or arms 15, each of the arms being disposed generally horizontally within the nozzle housing C. Between its two ends each lever arm 15 is supported by a bearing device 16 which is adjustable in height or distance from the work surfaces by a knob 17 and permits the arm to move in its length direction, while keeping its bearing point in a fixed vertical position. The other end of the arm is pivotally supported on a disc 18 by means of a stub shaft 19, which together with the disc forms an eccentric member. Thus, the disc rotates about its center by means of an electric motor (not shown) in the direction indicated by the arrow A in the FIGURE. The plane of the disc is vertically disposed so that the front of the lever arm on rotation of the disc will describe an ellipse, whose form depends on the distance between the bearing point and the two ends of the lever arm. Therefore, the bristle tips will also describe a corresponding movement and during their movement forwards be elevated from the work surface whereas the backward movement of the lever arm causes the bristle tips to move against the work surface and work up dust and larger dirt particles from the rug. It will be observed that the removal of the dust particles is facilitated if the rear edge of the nozzle opening is in the form of a wedge 20 resting on the work surface and scraping up the particles before they are engaged by the air flow.

The vertical height position of the brush is adjusted by the knob 17 so that the optimum position can be assumed. The knob also makes it possible to compensate for wear of the brush. Instead of the above adjustable bearing device it is possible to use a bearing device which is resiliently suspended so that the brush, when in contact with the rug or carpet will "float" on it.

The present construction and arrangement results in an effective means for stirring up dust and dirt particles, especially from short pile rugs, to the suction inlet of a vacuum cleaner.

What is claimed is:

1. A vacuum cleaner nozzle having an elongated suction opening located adjacent to the work surface, a brush in said suction opening positioned substantially co-axially therewith, means moving said brush in said opening generally transversely to the longitudinal axis of said brush and having an axis of rotation that is substantially parallel to said longitudinal axis of said brush, said means including a rotatable disc and an elongated arm secured at one end to said disc eccentrically of the axis of rotation of said disc and having said brush at the other end thereof, a support bearing located between the ends of said arm but being closer to said brush than said disc, said bearing supporting said arm for both axial and tilting movement thereof whereby when said disc is rotated said brush is caused to move in a closed elliptical path whereby said brush engages said work surface during a part of its movement and is raised from said work surface during another part of said movement.

2. The nozzle as claimed in claim 1 further comprising a scraping element positioned at the rear edge of said suction opening, the forward end of said scraping element engaging the surface to be cleaned and scraping up dust and dirt particles for entrainment with the air flow through said suction opening.

3. The nozzle as claimed in claim 1 wherein the axis of rotation of said disc is substantially parallel to the longitudinal axis of said brush.

4. The nozzle as claimed in claim 1 further comprising means for adjustably moving said bearing vertically to change the distance between the brush and the work surface.

* * * * *